US010522946B1

(12) United States Patent
Upadhyaya et al.

(10) Patent No.: US 10,522,946 B1
(45) Date of Patent: Dec. 31, 2019

(54) CONNECTORS WITH LOCKING TAB

(71) Applicant: Hewlett Packard Enterprise Development LP, Houston, TX (US)

(72) Inventors: Vigneshwara Upadhyaya, Bangalore (IN); Senthil Kumar Mariappapillai Rajarethinam, Bangalore (IN); Mark Andrew Denny, Santa Clara, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 16/132,680

(22) Filed: Sep. 17, 2018

(51) Int. Cl.
*H01R 13/639* (2006.01)
*E05B 73/00* (2006.01)
*E05B 37/02* (2006.01)
*H01R 13/627* (2006.01)

(52) U.S. Cl.
CPC ..... *H01R 13/6397* (2013.01); *E05B 37/02* (2013.01); *E05B 73/0082* (2013.01); *H01R 13/6275* (2013.01)

(58) Field of Classification Search
CPC ..... H01R 13/6271; H01R 13/6392; H01R 13/6397; H01R 13/6275
USPC ..... 439/352
See application file for complete search history.

(56) References Cited

U.S. PATENT DOCUMENTS 4,907,982 A * 3/1990 Wagaman ..... H01R 13/523 439/271
5,068,496 A * 11/1991 Favalora ..... F16L 5/06 174/654
5,211,576 A * 5/1993 Tonkiss ..... H01R 13/59 439/462
5,244,406 A * 9/1993 Vranish ..... B64G 1/641 439/362
6,364,687 B1 * 4/2002 Chen ..... H01R 13/6275 439/358
6,435,911 B1 * 8/2002 Payson ..... H01R 13/516 439/320
6,814,601 B2 * 11/2004 Lin ..... H01R 13/59 439/321
6,902,432 B2 * 6/2005 Morikawa ..... H01R 13/6275 439/607.41
6,991,479 B2 * 1/2006 Miao ..... G06F 21/85 439/133
7,014,490 B1 3/2006 Morikawa et al.
(Continued)

FOREIGN PATENT DOCUMENTS

GB 2510590 A 8/2014

OTHER PUBLICATIONS

Security Solutions, "Keyed USB Port Cable Lock," retrieved online Jun. 20, 2018, http://securitysolutions.ca/products/laptop-locks/keyed-usb-port-cable-lock/, pp. 1.

*Primary Examiner* — Tulsidas C Patel
*Assistant Examiner* — Peter G Leigh
(74) *Attorney, Agent, or Firm* — Brooks, Cameron & Huebsch PLLC

(57) ABSTRACT

In some examples, an apparatus includes a connector of an electronic device including a locking tab, wherein the connector fits into a corresponding connector of a host computing device; an arm coupled to the locking tab; and an actuator, wherein the actuator in a first position depresses the collapsible arm and disengages the locking tab; and the actuator in a second position releases the collapsible arm and engages the locking tab.

17 Claims, 7 Drawing Sheets

(56) References Cited

U.S. PATENT DOCUMENTS 7,160,137 B1 * 1/2007 Yeh ..... H01R 13/6397 439/358
7,367,832 B2 * 5/2008 Muhs ..... G02B 6/3879 439/318
7,467,978 B2 * 12/2008 Sundermeier ..... H01R 9/031 439/320
7,581,417 B1 * 9/2009 Chen ..... E05B 37/025 439/133
7,900,971 B2 * 3/2011 Chiu ..... F16L 5/00 285/207
7,913,527 B2 * 3/2011 Chen ..... E05B 37/02 439/133
7,950,944 B1 * 5/2011 Hertzler ..... H01R 13/639 439/314
8,342,865 B2 * 1/2013 Scheibelmasser .... E21B 17/028 439/191
8,529,283 B1 * 9/2013 Carden ..... H01R 13/6275 439/347
8,628,252 B2 * 1/2014 Matsumoto ..... G02B 6/3879 385/56
8,671,721 B2 * 3/2014 Yu ..... E05B 37/025 70/14
8,845,356 B2 * 9/2014 Cheatham ..... H01R 13/62 439/304
9,112,312 B2 * 8/2015 Katayanagi ..... H01R 13/6582
9,312,629 B2 * 4/2016 Smith ..... H01R 13/625
9,362,673 B1 * 6/2016 Rinker ..... H01R 13/6275
9,644,402 B1 * 5/2017 Su ..... E05B 73/0082
9,698,531 B2 * 7/2017 Su ..... H01R 13/6397
9,755,382 B2 * 9/2017 Gniadek ..... H01R 24/66
9,858,212 B2 * 1/2018 Clark ..... G06F 21/83
10,218,122 B1 * 2/2019 Rengifo ..... H01R 13/639
2005/0233639 A1 * 10/2005 Blosch ..... H01R 13/44 439/587
2006/0134962 A1 6/2006 Yeh
2007/0277566 A1 * 12/2007 Yu ..... E05B 73/0005 70/58
2009/0305542 A1 * 12/2009 Masuzaki ..... H01R 13/625 439/335
2015/0020189 A1 1/2015 Soffer
2017/0110831 A1 * 4/2017 Su ..... H01R 13/639
2017/0256970 A1 * 9/2017 Ciesinski ..... H01R 13/6675
2018/0109093 A1 * 4/2018 Gibson ..... H01R 13/648
2018/0212360 A1 * 7/2018 Motohashi ..... H01R 13/447

* cited by examiner

CONNECTORS WITH LOCKING TAB

BACKGROUND

External Universal Serial Bus (USB) devices may be connected to a host computing device. Because external USB devices are designed to be removable from a host computing device in a "plug and play" manner, they may be inserted or removed by a user. USB devices can include a standardized connection for peripheral devices such as keyboards, video cameras, printing devices, memory devices, and/or other types of peripheral devices. In some examples, the USB devices can be utilized as battery chargers for portable devices.

DETAILED DESCRIPTION

External USB devices, such as pen-drives and mobile network (e.g., 4G LTE) modems, may be used with host computing devices including network devices and mobile devices. Examples of network devices include, but are not limited to, switches, routers, wireless local area network (WLAN) controllers, and servers. During installation of network devices, for example, at a remote branch office and/or a data center, mobile network modems may be used to provide interconnectivity between branch offices and/or data centers. However, because previous approaches to external USB devices are designed to be removed from a host computing device by a simple pull, mobile network modems may be lost and/or stolen during or after installation of network devices as a result of unauthorized removal of the mobile network modems.

Some previous approaches to securing an external USB device to a host computing device include a physical coupling of an external USB device to a host computing device in addition to the insertion of the USB plug into a host connector of the host computing device. However, such an additional physical coupling includes a connection point on the host computing device, other than the host connector, at which the external USB device can be coupled to the host computing device. Not only does an additional coupling complicate connection of an external USB device to a host computing device, but it also complicates authorized removal of the external USB device from the host computing device. Additionally, a data center, for example, may include several external USB devices in close proximity to one another such that multiple additional physical couplings are in close proximity. Having multiple additional physical couplings in close proximity is cumbersome and the multiple additional physical couplings may become entangled. In contrast, the examples disclosed herein provide approaches for including a security mechanism within a connector, such as a USB connector, to prevent unauthorized removal of the connector from a host computing device. Thus, the security mechanism disclosed herein is self-contained and does not use additional components external to the USB connector.

Figure 1:
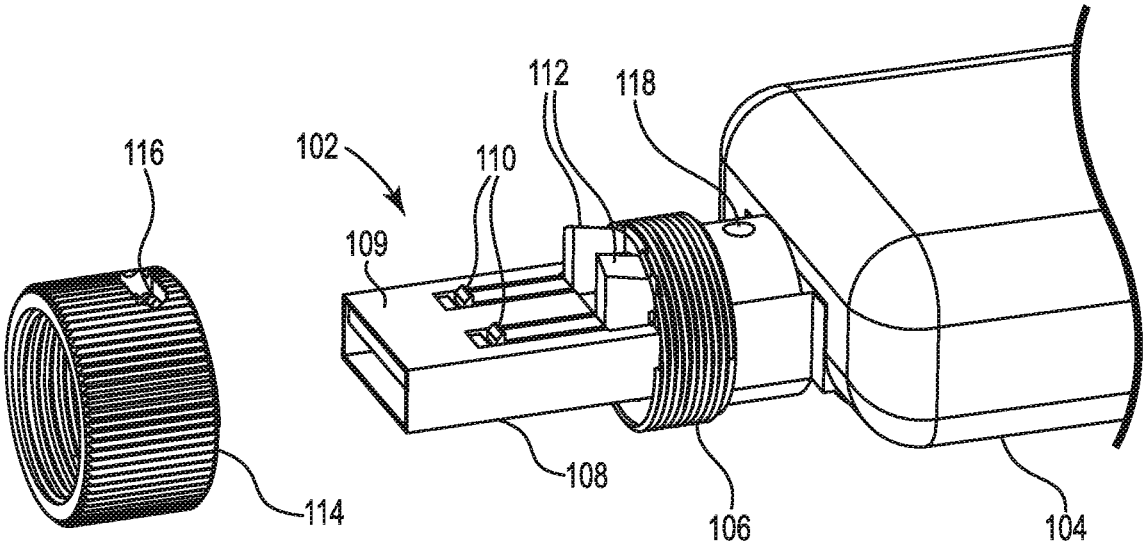
FIG. 1 is an exploded view of an example of a connector including locking tabs consistent with the present disclosure.

FIG. 1 is an exploded view of an example of a connector 102 of an electronic device including locking tabs 110 consistent with the present disclosure. As used herein, "connector" refers to a portion of an external device (e.g., an external USB device) for connecting the device to a host computing device. Examples of host computing devices include, but are not limited to, desktop computers, laptop computers, tablet computers, mobile devices, routers, access points, servers, printers, and monitors. Although implementations illustrated and discussed herein include a USB connector, implementations of the present disclosure are not so limited. The connector 102 can be a USB connector. For example, as illustrated in FIG. 1, the connector 102 is a USB Type A connector. The connector 102 includes a plug 108, which can be inserted into a corresponding host connector (not shown). As used herein, "plug" refers to a portion of a connector that is inserted into a host connector of a host computing device. As used herein, "host connector" refers to a complementary connector to receive the plug.

The connector 102 includes two locking tabs 110; however, implementations can include a single looking tab or more than two locking tabs, each of locking tabs 110 coupled to a respective arm 112. As used herein, "arm" refers to a compliant mechanism that deflects in response to a force and returns to an initial position in response to removal of the force. As used herein, "locking tab" refers to a protrusion on the arms. As illustrated in FIG. 1, the locking tabs 110 can be at an end of the arms 112; however, implementations consistent with the present disclosure are not so limited. The arms 112 are collapsible and can be depressed as discussed further in association with FIGS. 2, 3, and 4A-4C.

An actuator 114 is used to depress the arms 112 to disengage the locking tabs 110. As used herein, "actuator" refers to a mechanism that can be transitioned from a first position to a second position and from the second position to the first position. The actuator can be mechanical, electrical, or electromechanical. Examples of a mechanical actuator include, but are not limited to, a nut, a lever, a toggle switch, and a rack and pinion. A non-limiting example of an electrical actuator is a piezoelectric actuator (e.g., a bimorph). Examples of an electromechanical actuator include, but are not limited to, a solenoid and an electric motor.

As described herein, the actuator in a first position disengages the locking tabs 110 and the actuator in a second position engages the locking tabs 110. In at least one implementation of the present disclosure, the actuator in a first position applies a force to the arms 112 that causes the arms 112 to deflect to disengage the locking tabs 110. Transitioning the actuator from the first position to a second position removes the force from the arms, allowing the arms 112 to return (e.g., move opposite to the deflection) to an initial position, thereby engaging the locking tabs 110. As illustrated in FIG. 1, when the arms 112 are in the initial position, the arms 112 are flush, or nearly flush, with an exterior surface 109 of the plug 108. Consequently, when the arms 112 are in the initial position, the locking tabs 110 extend beyond the exterior surface of the plug 108.

As shown in FIG. 1, the actuator is a nut 114. As used herein, nut refers to an object having a hole from one end of the object to an opposing end of the object with threads along the inner surface of the hole. The hole of the nut 114 has a diameter so that the plug 108 can pass through the aperture of the nut 114.

The plug 108 abuts a device body 104. As used herein, "device body" refers to a portion of an external device including circuitry for operation of the external device. For example, if the external device is a mobile network modem, then the device body includes circuitry for receipt and transmission of data over a mobile network. If the external device is a pen-drive, for example, then the device body includes circuitry for storage of data (e.g., flash memory). In at least one implementation of the present disclosure the connector 102 includes a threaded extension 106. The threaded extension 106 couples the plug 108 to a device body 104. That is, the threaded extension 106 effectively "extends" the length of the connector 102 relative to some previous approaches. The threaded extension 106 includes threads along an outer surface of the threaded extension 106.

The threads of the threaded extension 106 complement the threads of the nut 114 such that the nut 114 can be threaded onto the threaded extension 106. The nut 114 can translate along the outer surface of the threaded extension. As described herein, the nut 114 can be partially threaded onto the threaded extension 106 (e.g., at a first position relative to the threaded extension 106) so that the nut 114 contacts the arms 112. As used herein, "partially threaded onto" refers to the nut 114 being threaded onto the threaded extension 106 so that the inner space of the hole of the nut 114 is partially filled, but not fully, by the threaded extension 106. The portion of the nut 114 not threaded onto the threaded extension 106 can contact the arms 112. By contacting the arms 112, the nut 114 applies a force to the arms 112 that causes the arms 112 to deflect.

As illustrated in FIG. 1, the arms 112 can have an angled surface. The angled surface faces the nut 114 so that a lowest point of the angled surface is adjacent to the threaded extension 106 and a highest point of the angled surface is near the plug 108. The highest point of the angled surface is outside the diameter of the hole of the nut 114. As the nut 114, threaded onto the threaded extension 106, translates along the threaded extension 106 towards the plug 108, the nut 114 makes contact with the angled surface. Because the arms 112 are collapsible, as the nut 114 makes contact with the angled surface at a lower point on the angled surface to a higher point on the angled surface, the arms 112 deflect. For example, if the highest point of the angled surface is two millimeters outside the diameter of the hole of the nut 114, then when the nut 114 fully covers the angled surface (e.g., the nut 114 contacts the highest point on the angled surface), the arms 112 deflect by approximately two millimeters.

The nut 114 can be fully threaded onto the threaded extension 106 (e.g., at a second position relative to the threaded extension 106). As used herein, "fully threaded onto" refers to the nut 114 being threaded onto the threaded extension 106 so that the inner space of the hole of the nut 114 is fully filled by the threaded extension 106. However, "fully threaded onto" does not necessarily mean that the nut 114 has to be threaded onto the threaded extension 106 such that the nut 114 has translated the length of the threaded extension 106. At the second position relative to the threaded extension 106, the nut 114 does not contact the arms 112. As such, the nut 114 does apply a force to the arms 112 so that the arms 112 are in an initial position (e.g., not deflected).

The threaded extension can include an aperture 118. As used herein, "aperture" refers to an opening. The nut 114 can include an aperture 116. As explained further herein in association with FIGS. 2, 3, and 5A-5C, the nut 114 can be threaded onto the threaded extension 106 so that the apertures 116 and 118 align. The aperture 116 can have a different geometry than the aperture 118. A fixation member can be inserted in the apertures 116 and 118 to maintain the orientation and position of the nut 114 relative to the threaded extension 106. As used herein, "fixation member" refers to an object that prevents movement (e.g., maintains position and orientation) of another object. Examples of a fixation member include, but are not limited to, a pin, a peg, and a screw. In at least one implementation, the fixation member can be a locking screw (e.g., 330 shown in FIG. 3). The aperture 118 can include threads (e.g., M2 threads) that complements threads on the fixation member. In at least one implementation, the aperture 116 can pass completely through the threaded extension 106, and the nut 114 can include another aperture opposite the aperture 118. Thus, a fixation member can pass through the aperture 116 of the nut 114, through the aperture 118 of the threaded extension 106, and at least partially through the other aperture of the nut. In at least one implementation, the fixation member can pass through the aperture 116 of the nut 114 and be screwed into the aperture 118. The fixation member can include a socket having a particular geometry (e.g., tri-wing socket) so that a person having a tool with the particular geometry (e.g., an authorized person) can remove the fixation member from the apertures 116 and 118.

Figure 2:
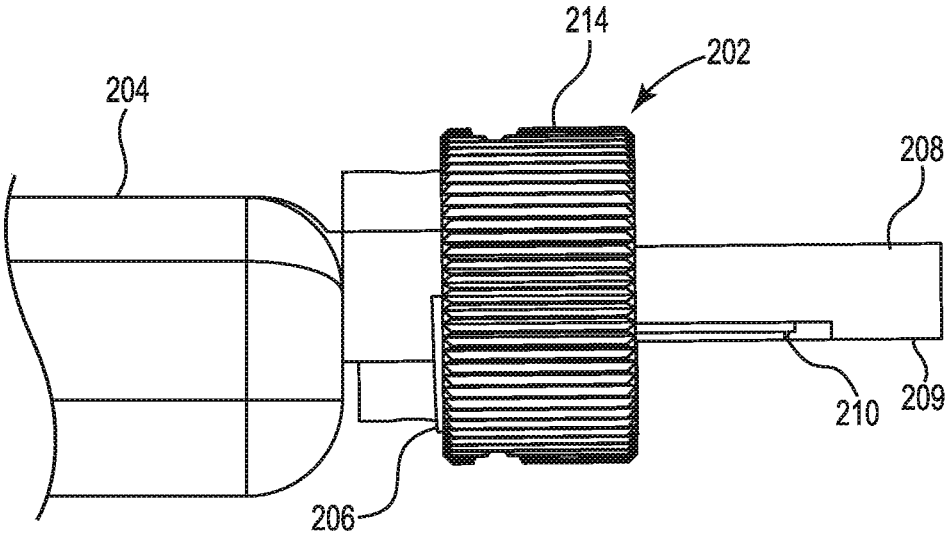
FIG. 2 is a side view an example of a connector of an electronic device where locking tabs are disengaged consistent with the present disclosure.

FIG. 2 is a side view an example of a connector 202 of an electronic device where locking tabs 210 are disengaged consistent with the present disclosure. As illustrated in FIG. 2, the nut 214 is at a first position relative to the threaded extension 206. The nut 214 is partially threaded onto the threaded extension 206 such that the nut 214 contacts the arms (e.g., 112 shown in FIG. 1). In FIG. 2, the arms are hidden by the nut 214 because the nut 214 fully covers the angled surface of the arms. As explained above and illustrated in FIGS. 4B and 4C, for example, when the nut 214 fully covers the angled surface of the arms, the nut 214 depresses the arms so that the arms deflect.

The nut 214 can be translated along the threaded extension to the first position by rotating the nut 214 in a first direction (e.g., counterclockwise) about the threaded extension 206. In which direction the nut 214 translates along the threaded extension when the nut 214 rotates in a first direction is dependent on the orientation of the threads on the nut 214 and the threaded extension 206. For example, in at least one implementation, rotating the nut 214 counterclockwise causes the nut 214 to translate along the threaded extension 206 away from the device body 204 and towards the plug 208 and rotating the nut 214 clockwise causes the nut 214 to translate along the threaded extension 206 towards the device body 204 and away from the plug 208. As described in association with FIGS. 4A-4C below, when the nut 214 translates along the threaded extension 206 away from the device body 204 and towards the plug 208 (e.g., towards the first position), the nut 214 gradually depresses the arms. Because the arms include locking tabs 210, depressing the arms also depresses the locking tabs 210, thereby disengaging the locking tabs 210. When the nut 214 is in the first position as illustrated in FIG. 2, the locking tabs 210 are disengaged and contained within the plug 208. As explained above, the nut 214 being in the first position as shown in FIG. 2 depresses the arms. So long as the nut 214 fully covers the angled surfaces of the arms, the arms will be depressed and the locking tabs 210 will be disengaged. With the locking tabs 210 disengaged, the plug 208 can be inserted into or removed from a host connector.

In at least one implementation, rotating the nut 214 clockwise causes the nut 214 to translate along the threaded extension 206 away from the device body 204 and towards the plug 208 and rotating the nut 214 counterclockwise causes the nut 214 to translate along the threaded extension 206 towards the device body 204 and away from the plug 208.

In contrast to some previous approaches that include a separate coupling of an external device to a host computing device to thwart and/or prevent unauthorized removal of the external device, the disclosed approaches include locking tabs (e.g., 210) coupled to the plug 208 and an actuator (e.g., the nut 214) to secure the existing connection of the external device to the host computing device. The disclosed approaches do not include a separate, additional connection of the external device to the host computing device. For example, to secure the connection of the connector 202 to the host computing device, after the plug 208 is inserted into the host connector of the host computing device, the nut 214 is rotated about the threaded extension (e.g., rotated clockwise) such that the nut 214 translates along the threaded extension 206, to the second position relative to the threaded extension 206, away from the plug 208. As a result, the nut 214 no longer makes contact with the angled surface of the arms causing the arms to return to their initial position which in turn engages the locking tabs 210. Accordingly, this is a security mechanism that is self-contained on the external device.

As described further in association with FIGS. 3 and 5A-5C, when the locking tabs 210 are engaged, the locking tabs 210 interface with the host connector to thwart and/or prevent removal of the plug 208 from the host connector. Thus, to secure an external device to a host computing device consistent with the present disclosure, the plug 208 is inserted into a host connector with the nut 214 in the first position (e.g., the nut 214 fully covers the angled surfaces of the arms 112) relative to the threaded extension 206, and then the nut 214 is rotated about and translated along the threaded extension 206 to the second position (e.g., the nut 214 fully uncovers the angled surfaces of the arms 112). Rotating the nut 214 does not complicate or significantly extend the process of connecting an external device to a host computing device. However, the external device can no longer be removed from the host computing device, by a passerby, for example, via a pull on the external device. A passerby would have to pause momentarily to rotate the nut 214 in order to remove the external device from the host computing device, which may discourage a passerby from attempting to remove the external device from the host computing device.

For additional security, a fixation member can be used to keep the nut 214 at the second position. A passerby would have to first remove the fixation member from the threaded extension 206 in order to rotate the nut 214. This further extends the amount of time a passerby would have to pause to remove the external device from the host computing device, which further discourages a passerby from attempting to remove the external device from the host computing device.

When authorized, to remove the external device from the host computing device consistent with the present disclosure, the nut 214 is rotated about and translated along the threaded extension 206 to the first position so that the nut 214 fully covers the angled surfaces of the arms. The plug 208 can then be removed from the host connector. Rotating the nut 214 does not complicate or significantly extend the process of removing an external device to a host computing device.

Figure 3:
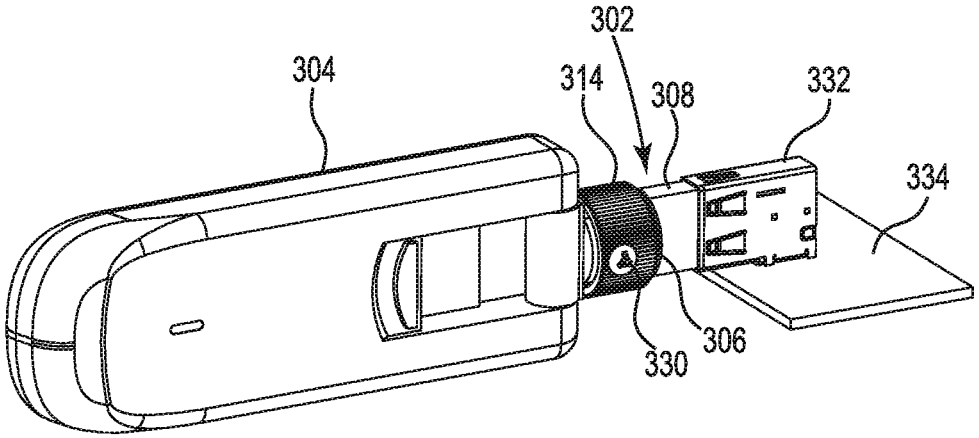
FIG. 3 is an example of a connector of an electronic device inserted into a host connector on a printed circuit board (PCB) consistent with the present disclosure.

FIG. 3 is an example of a connector 302 of an electronic device inserted into a host connector 332 on a printed circuit board (PCB) 334 consistent with the present disclosure. As used herein, "printed circuit board" refers to a flat insulating sheet including a conducting material (e.g., copper) to which electrical components (e.g., integrated circuits) and electrical connections (e.g., the host connector 232) can be attached. The host connector 332 on the printed circuit board (PCB) 334 can be part of a host computing device. The connector 302 fits into the corresponding host connector 332 of a host computing device.

While the host connector 332 shown in FIG. 3 is a Type A USB host connector, implementations consistent with the present disclosure are not so limited. As illustrated in FIG. 3, the nut 314 is at the second position relative to the threaded extension 306. As described above, the nut 314 can be translate along the threaded extension 306 towards the device body 304 and away from the plug 308 to the second position by rotating the nut 314 in a second direction (e.g., clockwise) about the threaded extension 306.

As shown in FIG. 3, a fixation member (a locking screw 330) is inserted through the aperture (e.g., 116 shown in FIG. 1) in the nut 314 and the aperture (e.g., 118) in the threaded extension 306. The locking screw 330 prevents changes in the position and orientation of the nut 314 relative to the threaded extension 306. Thus, the locking screw 330 keeps the nut 314 at the second position relative to the threaded extension 306. When the nut 314 is at the second position relative to the threaded extension 306, the arms (e.g., 112, not visible in FIG. 3) do not contact the nut 314. Thus, the arms are not depressed (deflected) and the locking tabs (not visible in FIG. 3) are engaged. This feature is discussed further in association with FIGS. 5A-5C below.

As illustrated in FIG. 3, the head of the locking screw 330 includes a tri-wing socket. The locking screw 330 cannot be removed from the threaded extension 306 without a tool having a complementary tri-wing driver. It is unlikely that a passerby would have a tool with the complementary tri-wing driver. To prevent unauthorized use of a tool, a log can be used to track who had possession of the tool so that if an external device is removed without authorization, a list of possible suspects can be generated.

Figure 4A:
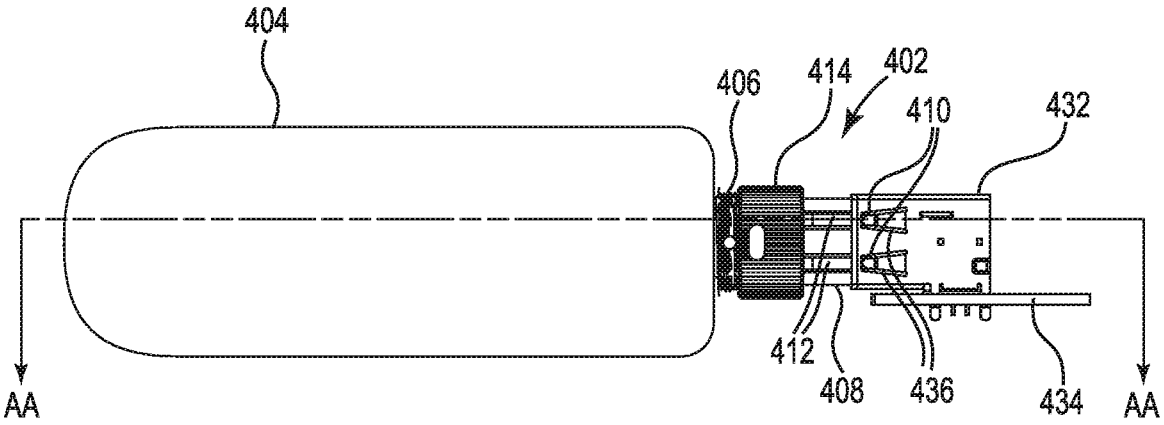
FIG. 4A is a side view an example of a connector of an electronic device where locking tabs are disengaged consistent with the present disclosure.

FIG. 4A is a side view an example of a connector 402 where locking tabs 410 are depressed consistent with the present disclosure. As illustrated in FIG. 4A, a portion of the threaded extension 406 is exposed because the nut 414 is at the first position relative to the threaded extension 406 (e.g., partially threaded onto the threaded extension 406). The disclosed approaches do not include any changes or modifications to the host connector 432. That is, the host connector 432 is not modified to include the apertures 436; the host connector 432 already includes the apertures 436. The locking tabs 410 are positioned on the arms 412 such that when the plug (e.g., 108 shown in FIG. 1) is inserted into the host connector 432, the locking tabs 410 align with apertures 436 of the host connector 432. As described further in association with FIGS. 5A-5C below, when the locking tabs 410 are engaged, at least a portion of the locking tabs 410 pass through a respective one of the apertures 436 of the host connector 432. For example, the locking tabs 410 can interface with an electromagnetic interface (EMI) finger of the host connector 432.

Figure 4B:
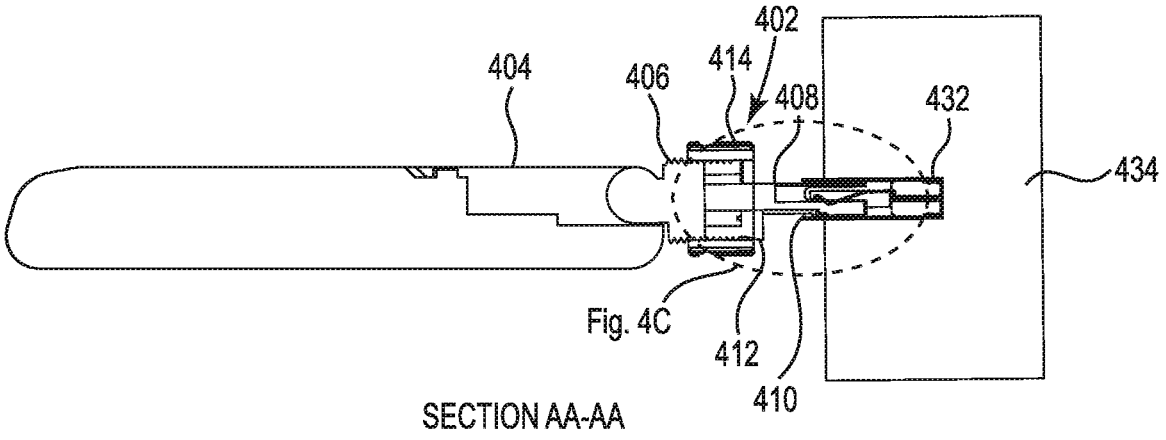
FIG. 4B is a cross-sectional view of the connector of FIG. 4A.

FIG. 4B is a cross-sectional view of the connector 402 at the section line AA shown in FIG. 4A. As illustrated in FIG. 4B, the nut 414 is partially threaded onto the threaded extension 406 such that the nut 414 depresses the arms 412. The nut 414 causes the arms 412 to deflect. The amount of deflection of the arms 412 is sufficient so that the lock tabs 410 protruding from the arms 412 are disengaged (e.g., contained with the plug 408). Thus, the locking tabs 410 do not inhibit or interfere with insertion of the plug 408 into the host connector 432 or removal of the plug 408 from the host connector 432.

Figure 4C:
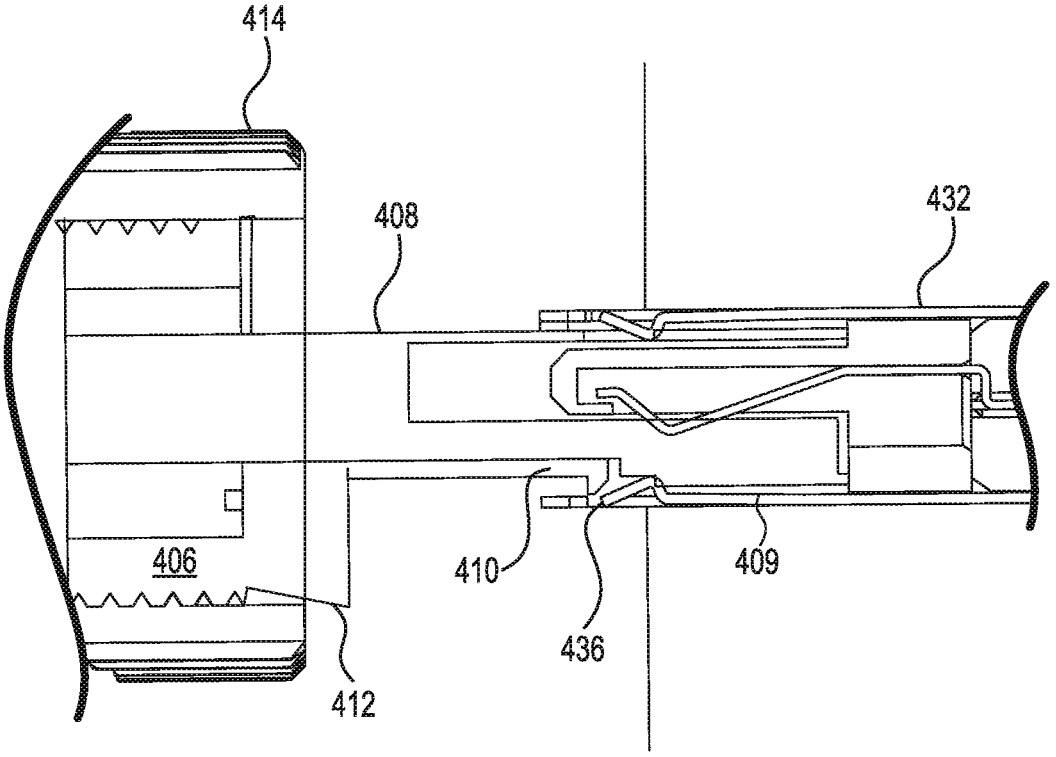
FIG. 4C is a close-up view of the cross-sectional view of the connector of FIG. 4B.

FIG. 4C is a close-up view of the cross-sectional view of the connector 402 of FIG. 4B. In the example illustrated in FIG. 4C, the nut 414 depresses the arms 412, causing the arms 412 to deflect so that the tip of the locking tabs 410 are flush, or nearly flush, with the exterior surface 409 of the plug 408. With the locking tabs 410 disengaged, the plug 408 can be inserted into the host connector via pushing and removed from the host connector 432 via pulling. When the plug 408 is fully inserted into the host connector 432, the locking tabs 410 are aligned with the apertures 436 of the host connector 432.

Figure 5A:
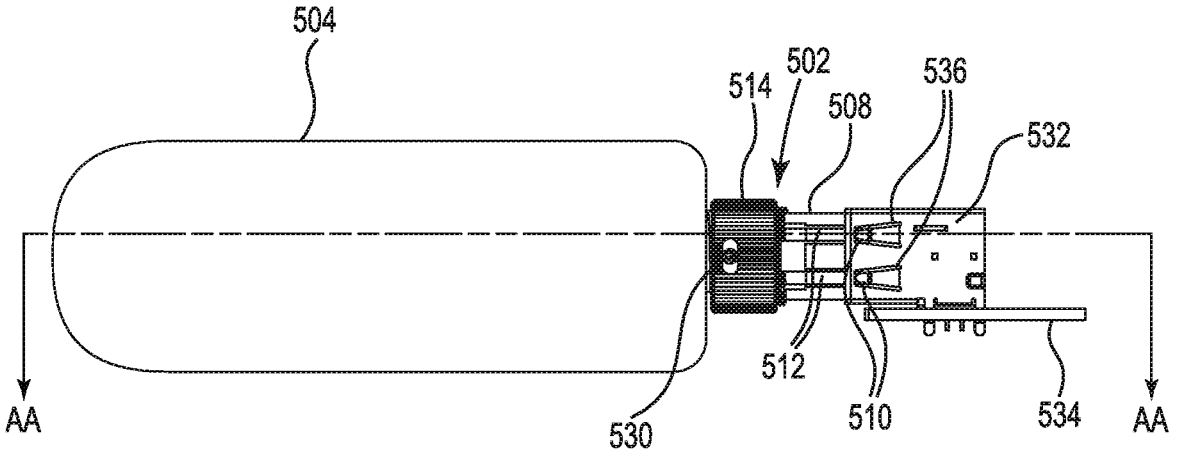
FIG. 5A is a side view an example of a connector of an electronic device where locking tabs are engaged consistent with the present disclosure.

FIG. 5A is a side view an example of a connector 502 of an electronic device where locking tabs 510 are engaged consistent with the present disclosure. As illustrated in FIG. 5A, the nut 514 is at the second position relative to the threaded extension 506. The nut 514 is threaded onto the threaded extension 506 so that the apertures (e.g., 116 shown in FIG. 1) in the nut 514 align with the aperture (e.g., 118) in the threaded extension 106. Because FIG. 5A is a side view of the connector 502, the tip of the locking screw 530 is shown within an aperture of the nut 514.

Figure 5B:
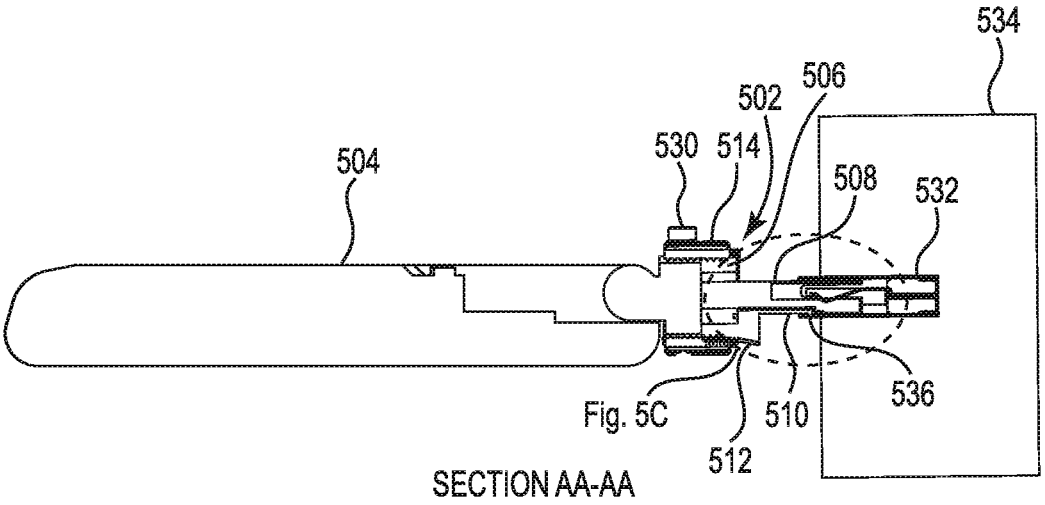
FIG. 5B is a cross-sectional view of the connector of FIG. 5A.

FIG. 5B is a cross-sectional view of the connector 502 at the section line AA shown in FIG. 5A. As illustrated in FIG. 5B, the nut 514 is threaded onto the threaded extension 506 such that the nut 514 does not contact the arms 512. As a result, the arms 512 is not deflected causing the locking tabs 510 to be engaged. When the locking tabs 510 are engaged, the locking tabs 510 interface with the apertures 536 of the host connector 532. As explained above, when the plug 508 is inserted into the host connector 532, the locking tabs 510 are aligned with the apertures 536. Because the locking tabs 510 protrude from the arms 512, if the arms 512 are not deflected then the locking tabs 510 extend beyond the exterior surface 509 of the plug 508. Consequently, when the locking tabs 510 are engaged while the plug 508 is inserted into the host connector 532, at least a portion of the locking tabs 510 pass through a respective one of the apertures 536. In at least one implementation, the locking tabs 510 interfaces with an electromagnetic interface (EMI) finger of the host connector 532.

Figure 5C:
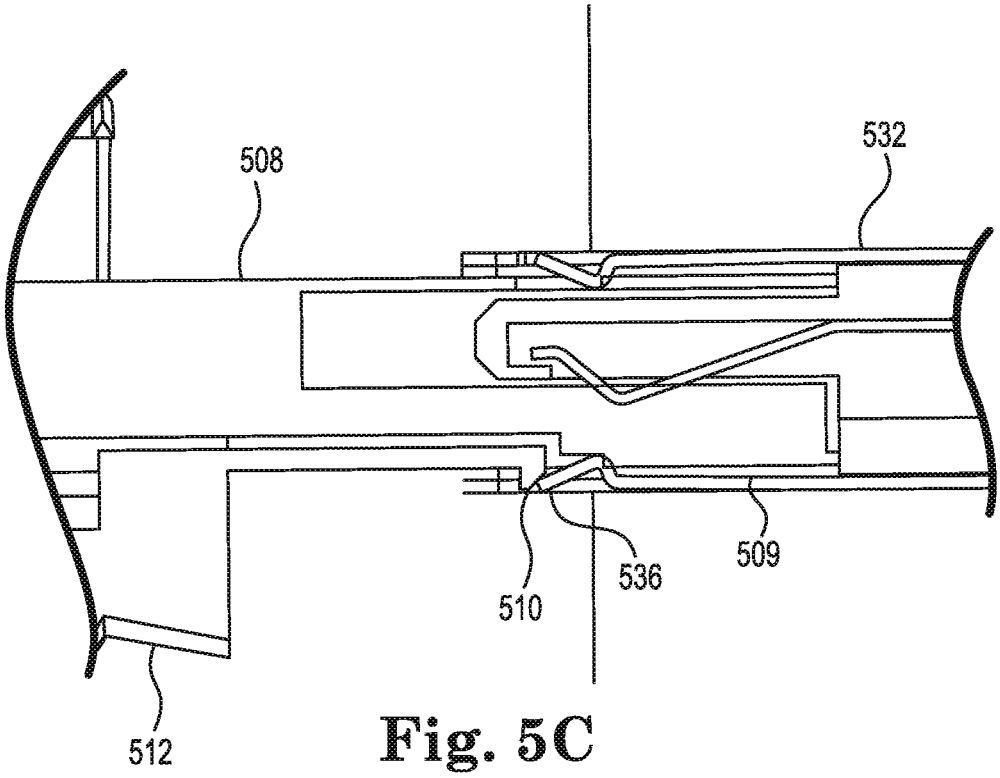
FIG. 5C is a close-up view of the cross-sectional view of the connector of FIG. 5B.

FIG. 5C is a close-up view of the cross-sectional view of the connector 502 of FIG. 5B. As illustrated in FIG. 5C, when the locking tabs 510 are engaged, at least a portion of the locking tabs 510 pass through the apertures 536. As such, if the device body 504 and/or the connector 502 is pulled so as to remove the plug 508 from the host connector 532, the locking tab 510 contacts the inner surface of the aperture 536. Pulling on the plug 508 causes the locking tabs 510 act as a hook or a latch, for example, within the apertures 536. The locking tabs 510 and the apertures 536 cooperate to inhibit and/or prevent removal of the connector 502 from the host connector 532.

As described above, in some previous approaches a connector of an external device can be removed from a host connector of a host computing device by pulling on the connector. Minimal resistance may be encountered in removing the connector of the external device from a host connector of a host computing device. In contrast, engaging the locking tabs 510 consistent with the present disclosure provides significant more resistance to a pull on the connector. For example, a passerby that attempts to remove an external device with engaged locking tabs 510 consistent with the present disclosure will encounter more resistance than likely anticipated. The increased resistance may prompt the passerby to abandon the attempt to remove the external device from the host computing device.

For additional security, the locking screw 530 can be inserted into the apertures in the nut 514 and threaded extension 506. If, for example, the greater than anticipated resistance to pulling on an external device does not discourage a passerby from attempting to remove the external device from the host computing device, the locking screw 530 serves as another obstacle to removing the external device from the host computing device. As explained above, to disengage the locking tabs 510, the nut 514 rotated about the threaded extension 506 to translate the nut 514 along the threaded extension 506 so that the nut 514 contacts and depress the arms 512. The locking screw 530 prevents movement of the nut 514. To rotate the nut 514, the locking screw 530 is removed first. Thus, the locking screw 530 further prevents and/or thwarts unauthorized remove of the connector 502 from the host connector 532.

Figure 6:
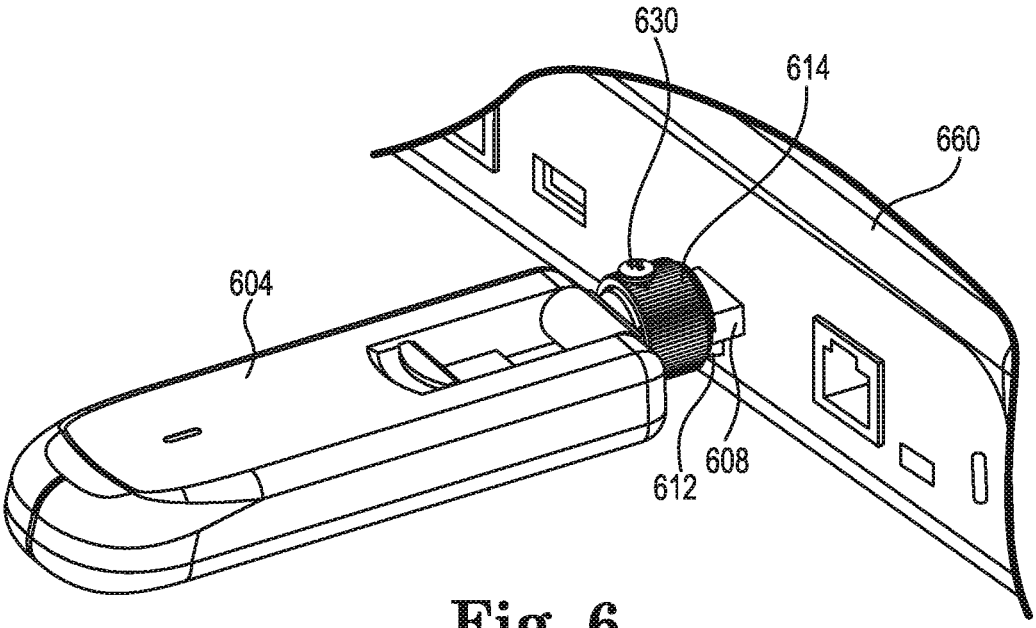
FIG. 6 is an example of a connector of an electronic device inserted into a horizontal host connector of a host computing device consistent with the present disclosure.

FIG. 6 is an example of a connector 602 of an electronic device inserted into a horizontal host connector of a host computing device 660 consistent with the present disclosure. The host connector illustrated in FIG. 6 can be analogous to the host connector 332 illustrated in FIG. 3, for example. As illustrated in FIG. 6, the nut 614 is at the second position relative to the threaded extension (hidden by the nut 614). Because the nut 614 does not contact the arms 612 (only one of the arms 612 are visible in FIG. 6), the arms 612 are in an initial position (e.g., not depressed). Thus, the locking tabs (not visible in FIG. 6) are engaged and interface with apertures in the host connector 632. A locking screw 630 is inserted in the nut 614 and the threaded extension.

The host computing device 660 may be a computing device with a processing resource. As used herein, a computing device may include a server, a networking device (e.g., a router, access point, etc.), a desktop computer, a workstation, a tablet, a movable device, an electronic reader, or any other processing device or equipment. As an example, a user of a laptop computer 660 may use a pen-drive. If the user is in a public space, such as a library or a coffee shop, a passerby may attempt to remove the pen-drive from the laptop computer 660. As explained above, a pen-drive including a connector (e.g., 102 shown in FIG. 1) having engaged locking tabs (e.g., 110) consistent with the present disclosure provides increased resistance to removal of the pen-drive from the laptop computer 660. Pulling on the pen-drive causes the locking tabs to contact an inner surface of apertures of the host connector 632, which may cause movement of the laptop computer 660. Thus, if the user was unaware of the attempt to remove the pen-drive, then movement of the laptop computer, and/or noise and/or vibration resulting from the movement of the laptop computer 660 may make the user aware of the attempt to remove the pen-drive.

Figure 7:
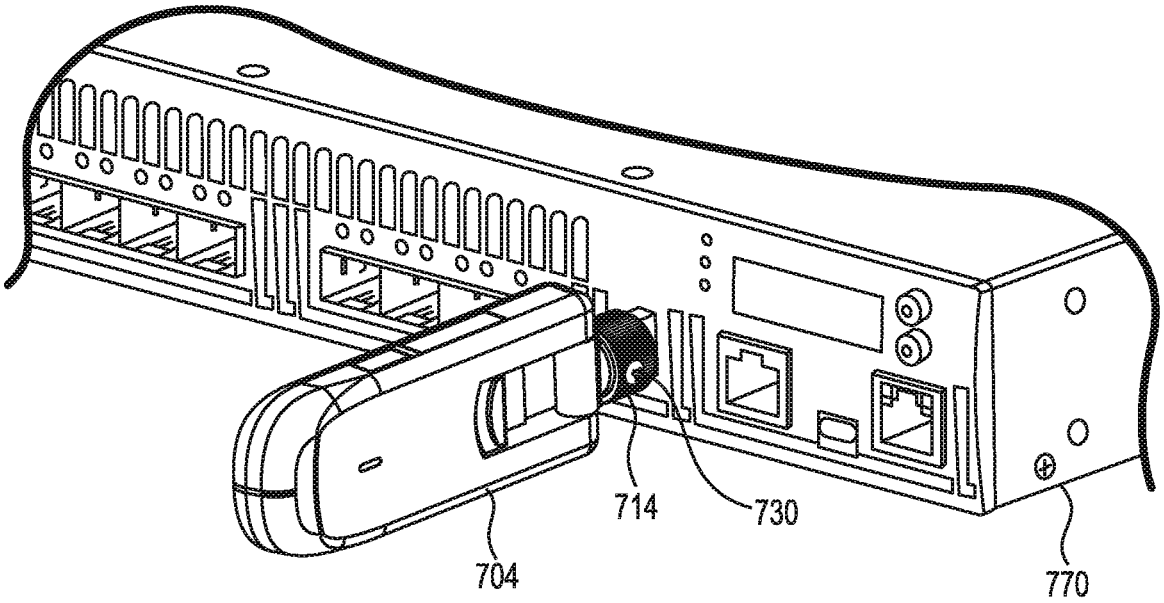
FIG. 7 is an example of a connector of an electronic device inserted into a vertical host connector of a host computing device consistent with the present disclosure.

FIG. 7 is an example of a connector 702 of an electronic device inserted into a vertical host connector of a host computing device 770 consistent with the present disclosure. The host connector illustrated in FIG. 7 can be analogous to the host connector 332 illustrated in FIG. 3, for example. As illustrated in FIG. 7, the nut 714 is at the second position relative to the threaded extension (hidden by the nut 714). Because the nut 714 does not contact the arms 712 (not visible in FIG. 7), the arms 712 are in an initial position (e.g., not depressed). Thus, the locking tabs (not visible in FIG. 7) are engaged and interface with apertures in the host connector 732. A locking screw 730 is inserted in the nut 714 and the threaded extension.

Examples of the host computing device 770 include, but are not limited to, a network device, a router, an access point, a server, printers, and monitors. As an example, during installation of a server 770, an external mobile network modem may be connected to the server 770 to provide mobile network interconnectivity to the server 770. During the installation of the server 770, the mobile network modem may be left unattended such that a passerby may attempt to remove the mobile network modem from the server 770. As explained above, a mobile network modem including a connector (e.g., 102 shown in FIG. 1) having engaged locking tabs (e.g., 110) consistent with the present disclosure provides increased resistance to removal of the mobile network modem from the server 770. Pulling on the mobile network modem causes the locking tabs to contact an inner surface of apertures of the host connector 732. Thus, if the passerby attempts to remove the mobile network modem from the server 770 while in motion, the increased resistance may prompt the passerby to abandon attempting to remove the mobile network modem from the server 770. As a further deterrent, the passerby would have to remove the locking screw 730 in order to rotate the nut 714 to disengage the locking tabs.

Figure 8:
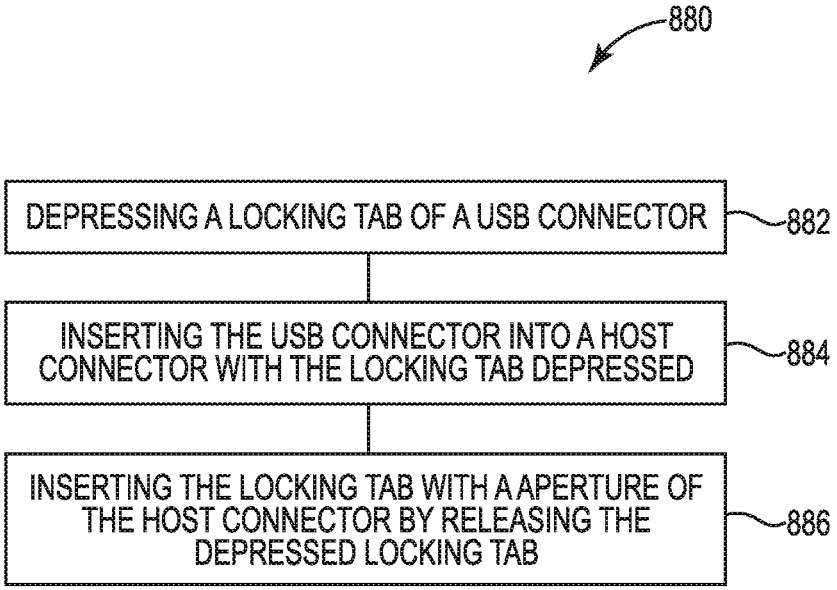
FIG. 8 illustrates an example of a method consistent with the disclosure.

FIG. 8 illustrates an example of a method 880 consistent with the present disclosure. The method 880 can be performed using the connector such as those described herein with respect to FIGS. 1-7. At 882, the method 880 can include depressing a locking tab of a USB connector (e.g., the locking tab 110 of the connector 102 illustrated in FIG. 1). At 884, the method 880 can include inserting the USB connector into a host connector (e.g., the host connector 332 illustrated in FIG. 3) with the locking tab depressed. At 886, the method 880 can include interfacing the locking tab with an aperture (e.g., the aperture 336) of the host connector by releasing the depressed locking tab.

Releasing the depressed locking tab can include rotating a nut (e.g., the nut 114) about a threaded extension (e.g., the threaded extension 106) of the USB connector in a first direction. Depressing the locking tab can include rotating the nut about the threaded extension in a second direction. Rotating the nut in the second direction can include depressing the locking tab with the nut.

Although not shown in FIG. 8, the method 880 can include securing the nut to the threaded extension in a fixed orientation. The method 880 can include depressing the released locking tab and removing the USB connector from the host connector.

In the foregoing detailed description of the disclosure, reference is made to the accompanying drawings that form a part hereof, and in which is shown by way of illustration how examples of the disclosure can be practiced. These examples are described in sufficient detail to enable those of ordinary skill in the art to practice the examples of this disclosure, and it is to be understood that other examples can be utilized and that process, electrical, and/or structural changes can be made without departing from the scope of the disclosure.

The figures herein follow a numbering convention in which the first digit corresponds to the drawing figure number and the remaining digits identify an element or component in the drawing. Similar elements or components between different figures can be identified by the use of similar digits. For example, 102 can reference element "02" in FIG. 1, and a similar element can be referenced as 202 in FIG. 2. Elements shown in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. Further, as used herein, "a plurality of" an element and/or feature can refer to more than one of such elements and/or features.

What is claimed:

1. An apparatus, comprising:

a connector of an electronic device including a locking tab, wherein the connector fits into a corresponding connector of a host computing device;

a threaded extension coupled to the connector, wherein the threaded extension couples the connector to a device body of the electronic device;

a collapsible arm coupled to the locking tab; and an actuator, wherein:

the actuator includes a nut movable along the threaded extension;

the nut in a first position depresses the collapsible arm and disengages the locking tab; and the nut in a second position releases the collapsible arm and engages the locking tab.

2. The apparatus of claim 1, further comprising a fixation member, wherein:

the actuator includes an aperture for the fixation member; and the fixation member secures the actuator in the second position.

3. The apparatus of claim 2, wherein the fixation member is a locking screw.

4. The apparatus of claim 1, wherein the connector is a Universal Serial Bus (USB) connector.

5. The apparatus of claim 4, wherein the USB connector is a USB Type A connector.

6. A system, comprising:

a Universal Serial Bus (USB) device including connector including:

a plug;

a locking tab;

a locking screw; and an actuator to engage the locking tab, wherein the actuator in a first position disengages the locking tab and the actuator in a second position engages the locking tab;

wherein the actuator includes an aperture for the locking screw and the locking screw secures the actuator in the second position; and a host computing device comprising a host connector to receive the plug, wherein the locking tab interfaces with an aperture of the host connector.

7. The system of claim 6, wherein at least of a portion of the locking tab passes through the aperture of the host connector.

8. The system of claim 7, wherein the USB device comprises a mobile modem.

9. The system of claim 6, wherein the host computing device is a network device.

10. The system of claim 6, wherein the host computing device is a mobile device.

11. The system of claim 6, wherein the host connector is a USB Type A host connector.

12. The system of claim 11, wherein the locking tab, when engaged, interfaces with an electromagnetic interface (EMI) finger of the host connector.

13. A method, comprising:

depressing a locking tab of a Universal Serial Bus (USB) connector;

inserting the USB connector into a host connector with the locking tab depressed; and interfacing the locking tab with an aperture of the host connector by releasing the depressed locking tab, wherein releasing the depressed locking tab includes rotating a nut about a threaded extension of the USB connector in a first direction.

14. The method of claim 13, wherein depressing the locking tab includes rotating the nut about the threaded extension in a second direction.

15. The method of claim 14, wherein rotating the nut in the second direction includes depressing the locking tab with the nut.

16. The method of claim 13, comprising securing the nut to the threaded extension in a fixed orientation.

17. The method of claim 13, comprising:

depressing the released locking tab; and removing the USB connector from the host connector.

* * * * *